US006681509B1

(12) United States Patent
Jean

(10) Patent No.: US 6,681,509 B1
(45) Date of Patent: Jan. 27, 2004

(54) ARTISTIC DISPLAY

(76) Inventor: France Jean, 2002-28 St SE., Calgary, AB (CA), T2B 0R7

( * ) Notice: Subject to any disclaimer, the term of this patent is extended or adjusted under 35 U.S.C. 154(b) by 190 days.

(21) Appl. No.: 09/655,889

(22) Filed: Sep. 6, 2000

(51) Int. Cl.[7] ..... G09F 13/00; G09F 13/04
(52) U.S. Cl. ..... 40/443; 40/574; 40/576
(58) Field of Search ..... 40/443, 574, 716, 40/715, 714, 564, 573

(56) References Cited

U.S. PATENT DOCUMENTS

| | | | | | |
|---|---|---|---|---|---|
| 230,741 | A | | 8/1880 | Caldwell | |
| 366,449 | A | | 7/1887 | Benjamin | |
| 454,560 | A | | 6/1891 | McNevin | |
| 770,319 | A | * | 9/1904 | Von Rudiger | 40/443 |
| 1,585,765 | A | | 5/1926 | Chitra | |
| 1,878,368 | A | | 9/1932 | Bielski | |
| 1,904,966 | A | | 4/1933 | Anderson | |
| 1,990,826 | A | | 2/1935 | Hodgkin | |
| 2,069,368 | A | * | 2/1937 | Horinstein | 40/564 |
| 2,118,320 | A | | 5/1938 | McEwen | |
| 2,225,307 | A | | 12/1940 | Kreeger | |
| 3,653,138 | A | | 4/1972 | Cooper | 40/130 R |
| 3,863,246 | A | | 1/1975 | Trcka et al. | 340/324 R |
| 3,957,351 | A | | 5/1976 | Stockwell | 350/160 |
| 4,126,384 | A | | 11/1978 | Goodman | 350/345 |
| 4,206,501 | A | | 6/1980 | Brooks | 362/293 |
| 4,330,813 | A | | 5/1982 | Deutsch | 362/244 |
| 4,405,210 | A | | 9/1983 | Baur | 350/345 |
| 4,440,474 | A | | 4/1984 | Trcka | 350/345 |
| 4,487,481 | A | | 12/1984 | Suzawa | 350/345 |
| 4,504,892 | A | | 3/1985 | Zulfilar | 362/234 |
| 4,652,979 | A | | 3/1987 | Arima | 362/80 |
| 4,673,254 | A | | 6/1987 | Kato et al. | 350/345 |
| 4,674,211 | A | | 6/1987 | Pratt | 40/564 |
| 4,748,546 | A | | 5/1988 | Ukrainsky | 362/223 |
| 4,832,459 | A | | 5/1989 | Harper | 350/345 |
| 4,842,378 | A | | 6/1989 | Flasck | 350/345 |
| 4,856,877 | A | | 8/1989 | Nishimori | 350/356 |
| 4,874,228 | A | | 10/1989 | Aho et al. | |
| 5,003,715 | A | * | 4/1991 | Steiner | 40/443 |
| 5,077,646 | A | | 12/1991 | Parsons | 362/252 |
| 5,155,669 | A | | 10/1992 | Yamuro | 362/252 |
| 5,430,626 | A | | 7/1995 | Leffel | 362/121 |
| 5,613,764 | A | | 3/1997 | O'Brien | 362/252 |
| 5,624,181 | A | | 4/1997 | Miller et al. | 362/252 |
| 5,628,557 | A | | 5/1997 | Huang | 362/252 |
| 5,712,770 | A | | 1/1998 | Huang | 362/252 |

FOREIGN PATENT DOCUMENTS

| | | |
|---|---|---|
| GB | 2119497 | 11/1983 |

* cited by examiner

*Primary Examiner*—Cassandra H. Davis

(57) ABSTRACT

An artistic display (10) provides backlighting to display graphics that may include one or more paintings, each with paint on one or both sides. The display graphics (100) comprise an outer canvas element (110), and optionally, an inner canvas element (120). Both sides of each canvas element may by covered, all or in part, with a coating of paint in a plurality of colors and thicknesses. A picture frame (280) is supported by a front peripheral surface of the backlighting box frame, and a rear peripheral surface of the frame supports a back wall. A light reflective surface (260) may be carried by the back wall. A lighting assembly (300) is located directly behind the outer canvas element, and is supported by a backlighting box frame (200). Where an inner canvas element is present, a rear lighting assembly is carried immediately behind this element. An automatic switching assembly (500) is in electrical communication with a power source, and automatically cycles power on and off. An automatic dimmer assembly (600) is in communication with the lighting assemblies, and automatically varies the voltage when power is applied.

4 Claims, 8 Drawing Sheets

ARTISTIC DISPLAY

CROSS-REFERENCES

There are no applications related to this application filed in this or any foreign country.

BACKGROUND

The method and associated apparatus used to illuminate generally planar works of art, such as paintings, are standardized. In a typical application, the apparatus includes ceiling- or track-mounted spotlights that illuminate the artwork, frame and a surrounding area of a supporting wall. Such lighting systems reflect light off the art, thereby increasing its visibility. However, such lighting systems do not transmit light through the work of art.

The standard methods of illuminating graphical art result in art having single appearance. That is, the artwork is either illuminated or not; the illumination does not result in a changed appearance, only a brighter appearance.

The standard methods of illuminating graphical art results in art having a static appearance. No illusion of motion results from the illumination.

What is needed is an artistic display for the support of display graphics, such as a painting, that can create a substantial difference in the appearance of the graphics by causing light to be transmitted through the graphics, and to cause light to be unevenly absorbed by the graphics, as it is viewed. The lighting carried within the artistic display should result in substantial change in the appearance of the display graphics. And further, the lighting carried within the artistic display should allow the creation of the illusion of motion.

ARTISTIC DISPLAY

The present invention is directed to an artistic display 10 having backlit display graphics, which provides some or all of the following elements.

(A) Display graphics 100 includes a canvas element 110, and optionally a second canvas element 120. Each canvas element includes two sides defining first and second surfaces. Each surface may support a coating of paint, depending on the requirements of the artistic expression. In one version of the artistic display, a hole is defined in a portion of the second canvas element. In such an application, the light of the rear lighting assembly passes through the hole and makes contact with the outer canvas element.

(B) A backlighting box 200 includes a frame formed of interlocking top, side and bottom elements. A planar back wall, carried by a rear peripheral edge of the frame, supports a reflective surface.

(C) A picture frame 280 is carried by front perimeter surface of the frame of the backlighting box. In one version of the invention, the picture frame supports the canvas element, and is reversibly attachable to the frame of the backlighting box. Reversible attachment allows either the first or second surface of the canvas element to be oriented outwardly. Fastening elements carried by the picture frame and the front perimeter surface of the frame of the backlighting box allow convenient attachment and removal of the picture frame for reversal of the canvas orientation or for substitution of different picture frames and associated display graphics.

(D) A lighting assembly 300 is carried by the backlighting box, behind the canvas element. A preferred lighting includes wire-hiding rails supporting a pair of bulb sockets associated with each fluorescent tube present and a ballast if required to operate the fluorescent tubes. Typically, an on/off toggle switch 700 controls the lighting assembly, and extends externally for ease of access.

(E) An automatic switching assembly 500 is wired between the lighting assembly and the power source, in a manner that allows it to cycle power on and off. The automatic switching assembly may include a programmable timer that may cycle power in concert with the changing of day and night, or in a regular, random or preprogrammed cycle of operation unconnected with the hour of day.

Alternatively, or additionally, the automatic switching assembly may be independently attached to each of several fluorescent tubes or other lighting element. By turning each tube on and off in sequence, the illusion of motion may be created by illuminating sections of the display graphics in sequence.

(F) An automatic dimmer assembly 600 is in electrical communication with the lighting assembly, and cycles the applied voltage in a manner that raises and lowers the illumination level of the lighting assembly. The automatic dimmer assembly may include a programmable timer that may cycle voltage in concert with the changing of day and night, or in a regular, random or preprogrammed cycle of operation unconnected with the hour of day.

It is therefore a primary advantage of the present invention to provide a novel artistic display having one or more canvas elements having paint applied to portions of surfaces on both sides, and supported by a backlighting box frame having one or more lighting assemblies which illuminate the canvas elements for viewing. In particular, it is a primary advantage that the appearance of the artistic display with the lighting assemblies on is markedly different than with them off. Moreover, the interaction between the two appearances is also advantageous.

Another advantage of the present invention is to provide a novel artistic display, having one or more canvas elements lit from behind by one or more lighting assemblies, that may also be used to provide low-level, subtle lighting for an adjacent area, and which may be used as a lamp or lighting fixture.

Another advantage of the present invention is to provide a novel artistic display, having display graphics comprising a canvas element carried by a picture frame having fastening means which allow reversal of the picture frame and canvas element, whereby the painting on either side of the canvas element may be directed outwardly.

A still further advantage of the present invention is to provide a novel artistic display, having one or more canvas elements lit from behind by one or more lighting assemblies, wherein the lighting assemblies interacts with the paint on both sides of each canvas element, enhancing and altering the colors and intensities of the work, in some cases changing the appearance of the art by making visible textures and other features resulting from different levels of light transmission through different areas of the work.

These and other features, aspects, and advantages of the present invention will become better understood with reference to the following description and appended claims.

DRAWINGS

These and other features, aspects, and advantages of the present invention will become better understood with regard to the following description, appended claims, and accompanying drawings where:

DESCRIPTION

Figure 1:
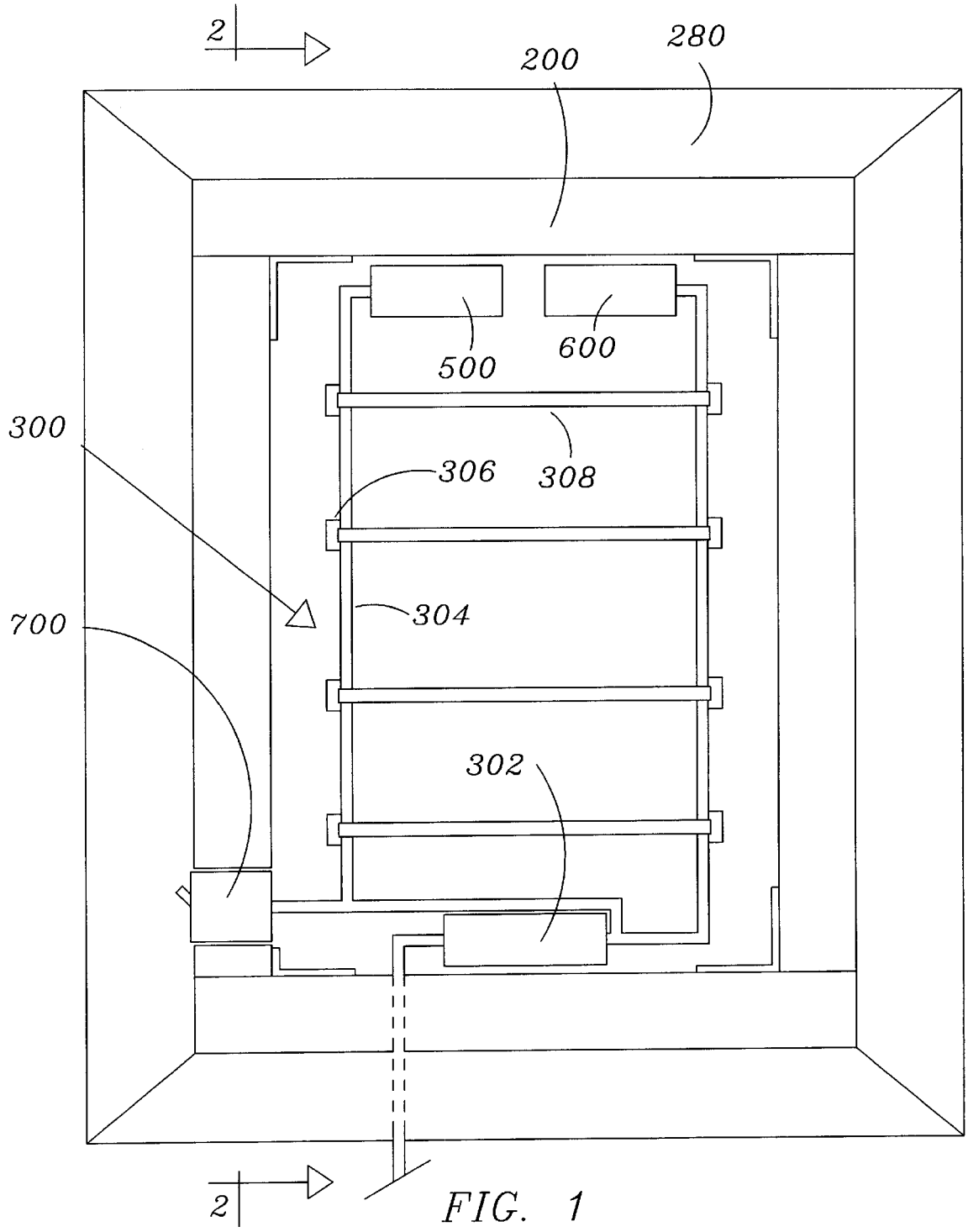
FIG. 1 is a front view of a preferred version of the artistic display of the invention, with the display graphics removed, having four horizontally oriented fluorescent bulbs, rails concealing the wiring, an on/off switch, a ballast, an automatic switching device and an automatic dimmer assembly.
Figure 2:
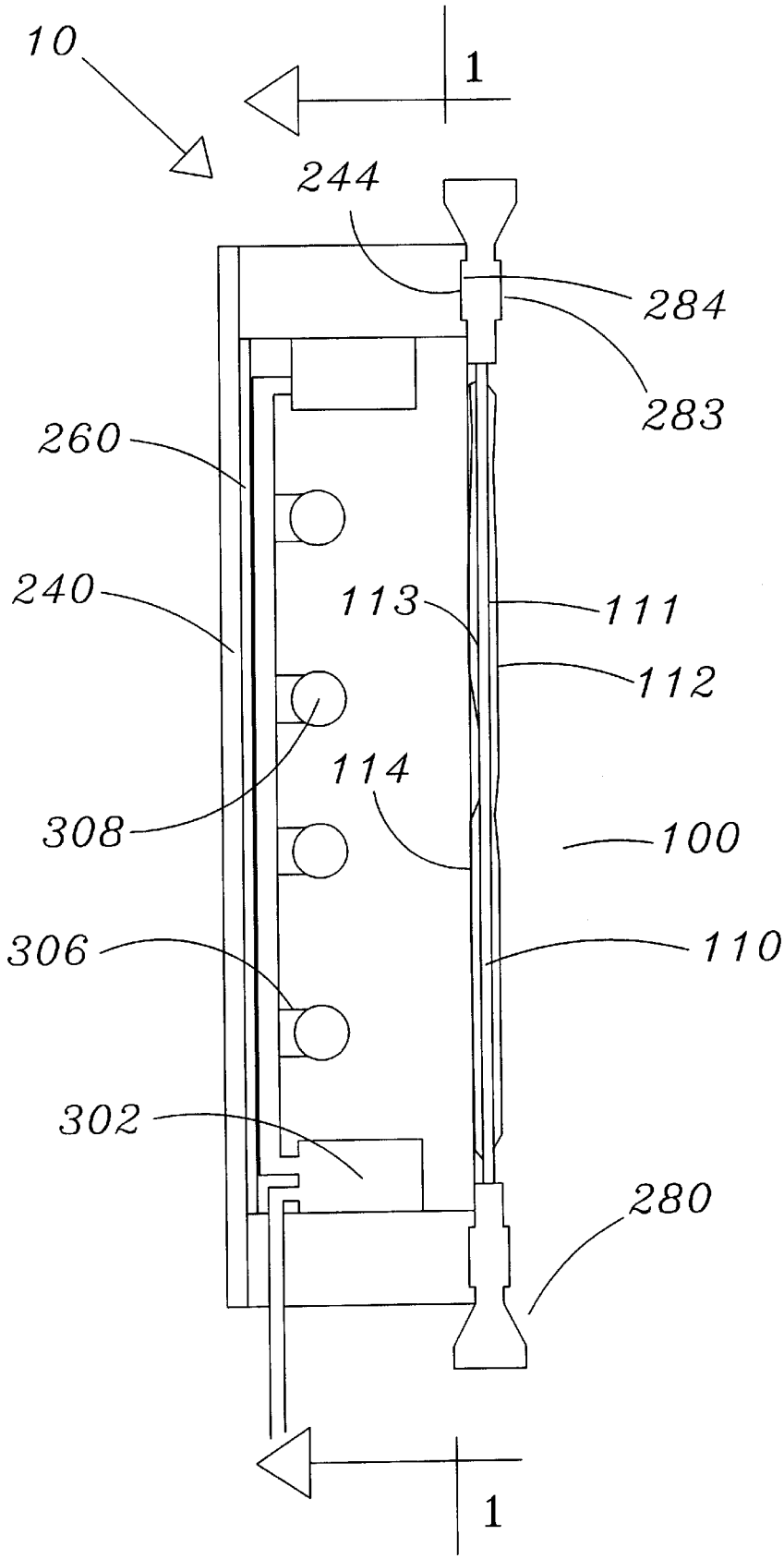
FIG. 2 is a cross-sectional view of the version of the artistic display of FIG. 1, particularly illustrating how display graphics comprising a single canvas element may have a coating of paint on both sides.

Referring in particularly to FIGS. 1 and 2, an artistic display 10 constructed in accordance with the principles of the invention is seen. A backlighting box frame 200 includes a frame having top, bottom and side elements supporting a back wall having a reflective surface. A picture frame 280 is supported by a front peripheral surface of the backlighting box frame. In a preferred embodiment display graphics 100 comprises at least one canvas element defining first and second (front and back) surfaces, each having an artistic design which may include a painted picture. In one embodiment, the canvas element is supported by a version of the picture frame having fastening elements on both sides. Because either side of the picture frame may be attached to the frame of the backlighting box, either the artwork carried by the first or second surface may be oriented outwardly. A lighting assembly 300 is carried within the backlighting box. When the lighting assembly is not activated, the artwork on the outer surface of the canvas element is visible. When the lighting assembly is on, elements of the artwork on both sides of the canvas element are visible. An automatic switching assembly 500 may be electrically connected to the power source, and automatically cycles power on and off. An automatic dimmer assembly 600 may be electrically connected between the automatic switching assembly and the lighting assemblies, and automatically varies the voltage when power is applied.

Referring to the figures, the frame 200 is typically constructed of parallel side elements 222 connected by a top element 224 and a bottom element 226. The material used in the construction can be selected from a wide range of choices based on the individual needs of the picture frame support desired. In general, the depth of the frame elements (i.e. the distance between the picture frame 280 and the back wall 240) is typically 3 to 4 inches, but may be a greater or lesser depth, as desired. The requirement is only that sufficient space be provided within the lighting cavity 236 to allow for the lighting assembly, possibly including any needed transformers or ballast, the automatic switching assembly 500 and automatic dimmer assembly 600.

In a preferred embodiment of the invention, a switch passage 228 is defined in one of the side elements 222. The switch passage allows the installation of an on/off switch 700 in a manner that allows access to the switch toggle from the outside of the frame. The switch passage must also be located so that there is access within the lighting cavity 236 to electrical contacts carried by the switch. In the version of the invention of FIGS. 1 and 3, the switch passage 228 is a notch defined in one of the side elements 222. Alternatively, the switch and switch passage 228 may be located on the bottom or back of the backlighting box frame.

Figure 3:
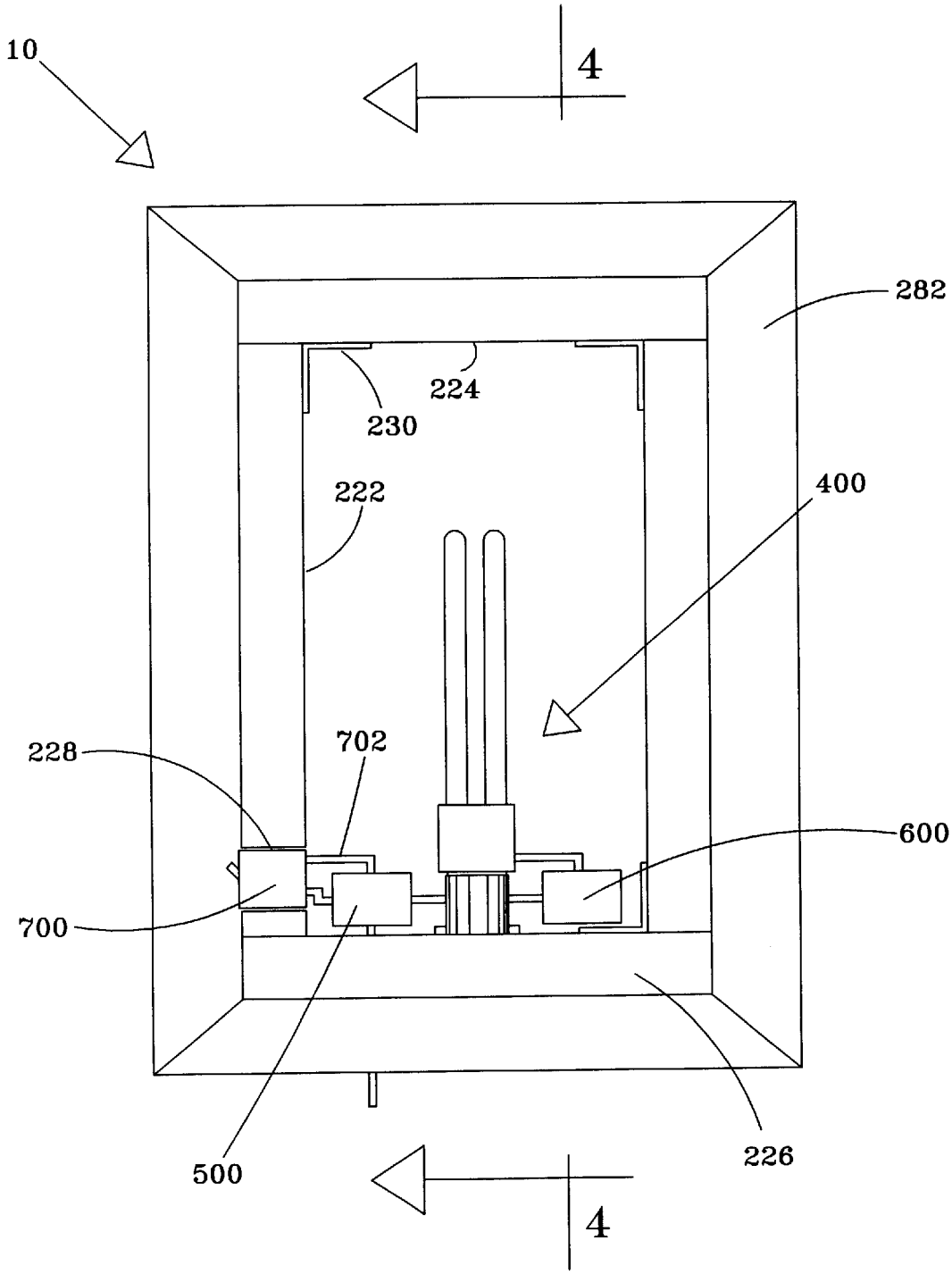
FIG. 3 is a rear orthographic view of a version of the artistic display of the invention having a multi-tube fluorescent bulb. The back wall has been removed to allow view into the lighting cavity.

The frame 200 may be assembled with joining hardware 230 of an appropriate known variety. Where the frame is rectangle, the joining hardware may include angle braces, as seen in FIGS. 1 and 3. Where the frame comprises a greater of lesser number of sides, the joining hardware may be appropriately selected for the application.

The frame 200 provides a forwardly facing peripheral surface 232 for connection to the picture frame 280. The shape and dimensions of the frame, including particularly the dimensions of the peripheral surface 232 should be sized for support of the picture frame, which in turn should be sized for support of the display graphics 100.

A rearwardly facing peripheral surface 234 of the frame 200 may carry a back wall 240. Alternatively, the back may be left open, particularly where the backlighting box is to be used against a window or other light source. If used, the back wall 240 is typically sized to equal to the outside dimensions of the frame. The back wall is typically light colored, to reflect light toward the display graphics. In a preferred application, the back wall is made of material that is heat resistant, not flammable and that resists discoloration.

Figure 5:
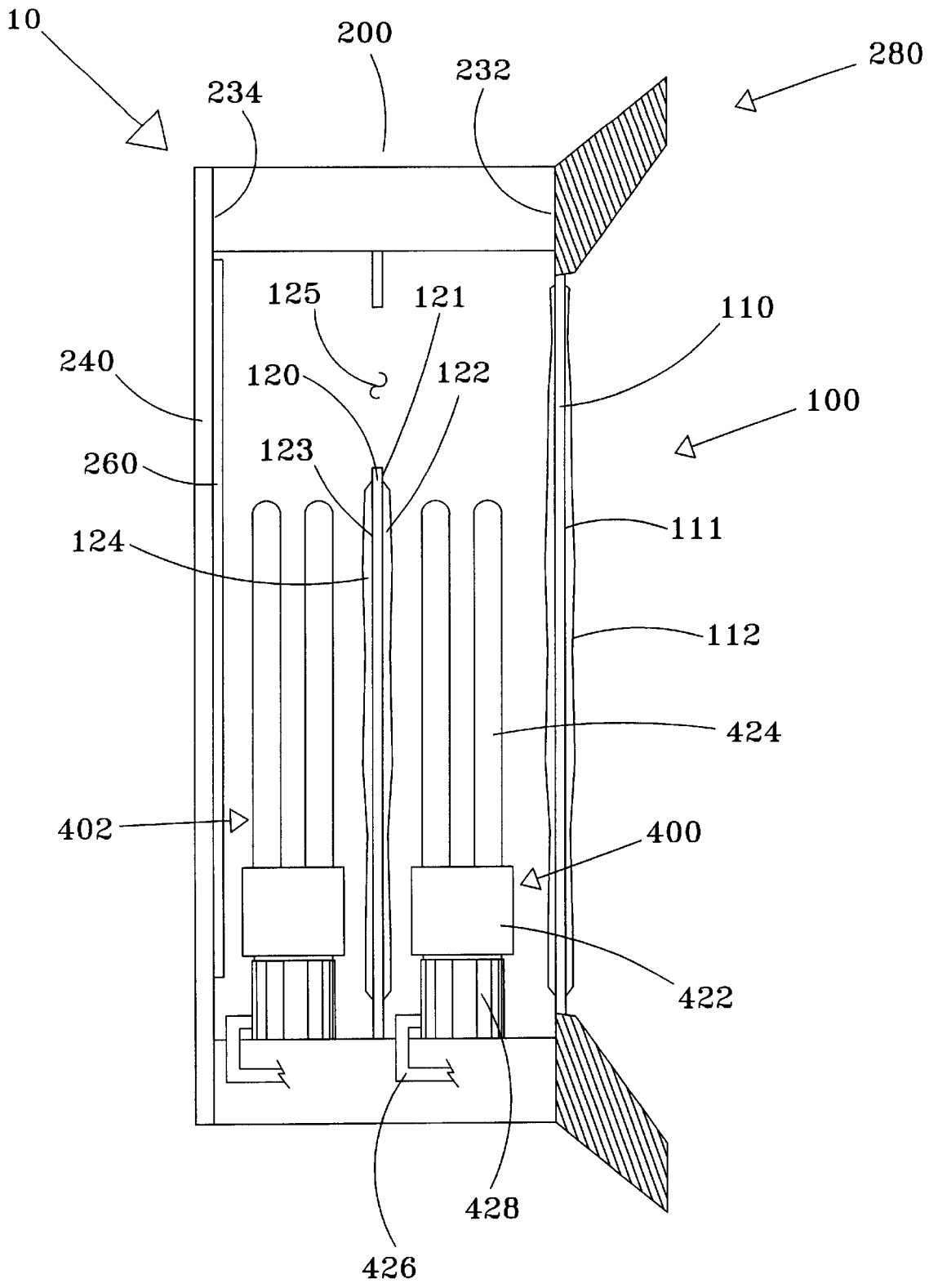
FIG. 5 is a side cross-sectional view similar to that of FIG. 4, having the back wall installed and having display graphics comprising both outer and inner canvas elements shown in cross-section.

As seen in FIGS. 2 and 5, a light reflective surface 260, such as a sheet of aluminum, may be attached to an inside surface of the back wall 240. The reflective surface reflects light toward the display graphics in a manner that decreases the wattage required of the lighting assemblies.

A cord passage hole 242 is typically defined in the bottom element 226, but may alternatively be defined in another area of the frame or in the back wall. The cord passage hole allows the power cord 702 to enter the lighting cavity 236, where it typically is connected to the externally extending on/off toggle switch 700.

Figure 4:
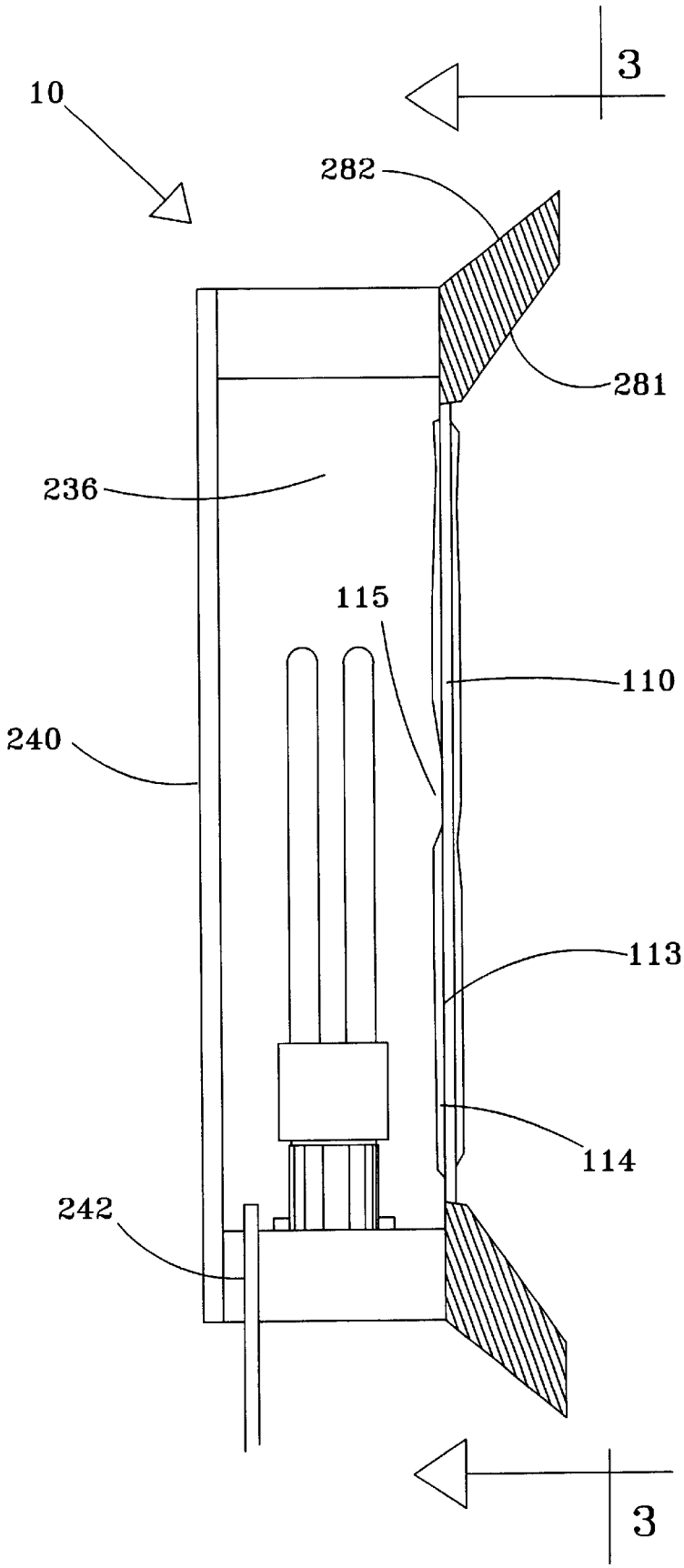
FIG. 4 is a side cross-sectional view of the backlighting box of FIG. 3, having the back wall installed and having display graphics comprising only an outer canvas element shown in cross-section.

The picture frame 280 is supported by a front peripheral surface 232 defined on the backlighting box frame 200. The picture frame supports a peripheral edge of the canvas element 110, while at the same time providing an attractive display environment. The rear surface 282 of a preferred picture frame is seen in FIGS. 1 and 3, while the forward and rear surfaces 281, 282 are seen in FIGS. 2 and 4. Alternatively, any style of picture frame may be substituted, provided that its dimensions are consistent with those of the front peripheral surface 232 of the backlighting box.

Referring to FIG. 2, a reversible version of the picture frame is seen. Either side of the reversible picture frame may be attached to the front peripheral surface of the frame of the backlighting box frame in a manner that allows either the first or second surfaces 111, 113 to be oriented outwardly.

Continuing to refer to FIG. 2, a picture frame fastening element or socket 244, defined in the front peripheral surface 232, may be seen. The picture frame fastening element 244 releasable mates with either fastening element 283, 284 on the picture frame, allowing either side of the picture frame to be attached to the outer perimeter of the frame of the lighting box.

In a preferred embodiment of the artistic display, the display graphics 100 includes a canvas element 110, and optionally, an inner canvas element 120. FIGS. 2 and 4 illustrate versions of the invention having an outer canvas element only. FIG. 5 illustrates a version of the invention having both an outer canvas element and an inner canvas element.

Referring to both FIGS. 2, 4 and 5, it can be seen that the outer canvas element 110 and inner canvas element 120 have similar construction. Both canvas elements define an outside surface 111, 121 that carries an outer layer of paint 112, 122. The outer layer of paint typically completely covers the surface; however, complete coverage is not required.

An inside surface 113, 123 or each canvas element typically also carries a layer of paint 114, 124. Again, in many instances, paint covers the surface completely; however, an area without paint 115 may be present.

To achieve a desired appearance, the degree of translucence of the inner and outer canvas elements may be varied by shaving some of the paint off of either or both of the inner and outer surfaces. Also, the thickness of the canvas may be reduced somewhat, without resulting in a hole. A thin polyester canvas is preferred, due to light transmission characteristics. As seen in FIGS. 2 and 3, the thickness of the paint is not always consistent, and has in places been varied by shaving or brushing off excess paint. Additionally, the canvas may be thinned somewhat by shaving, which result in still greater light passage through the canvas.

As seen in FIG. 5, in some versions of the artistic display, the inner canvas element 120 defines a hole 125. The hole allows the passage of light directly from the rear lighting assembly 340 to the inside surface of the outer canvas element. Thus, the light intensity acting upon this portion of the outer canvas element may be greater, due to the lack of obstruction in the area of the hole 125. By selection of the size, shape and location of the hole, the artist may achieve a desired effect.

Figure 9:
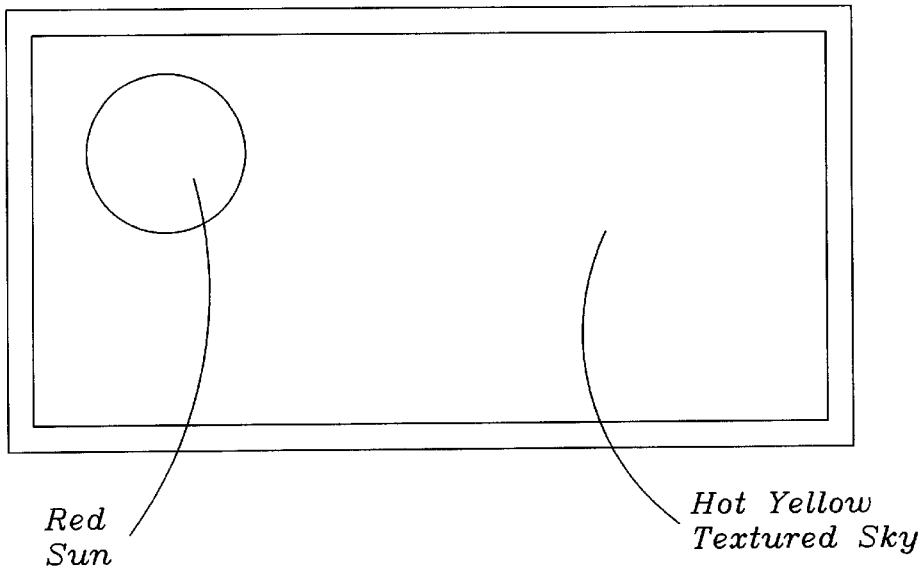
FIG. 9 is an orthographic view of an example painting, showing how with the backlight off, a red sun and a hot yellow textures sky are all that is visible.
Figure 10:
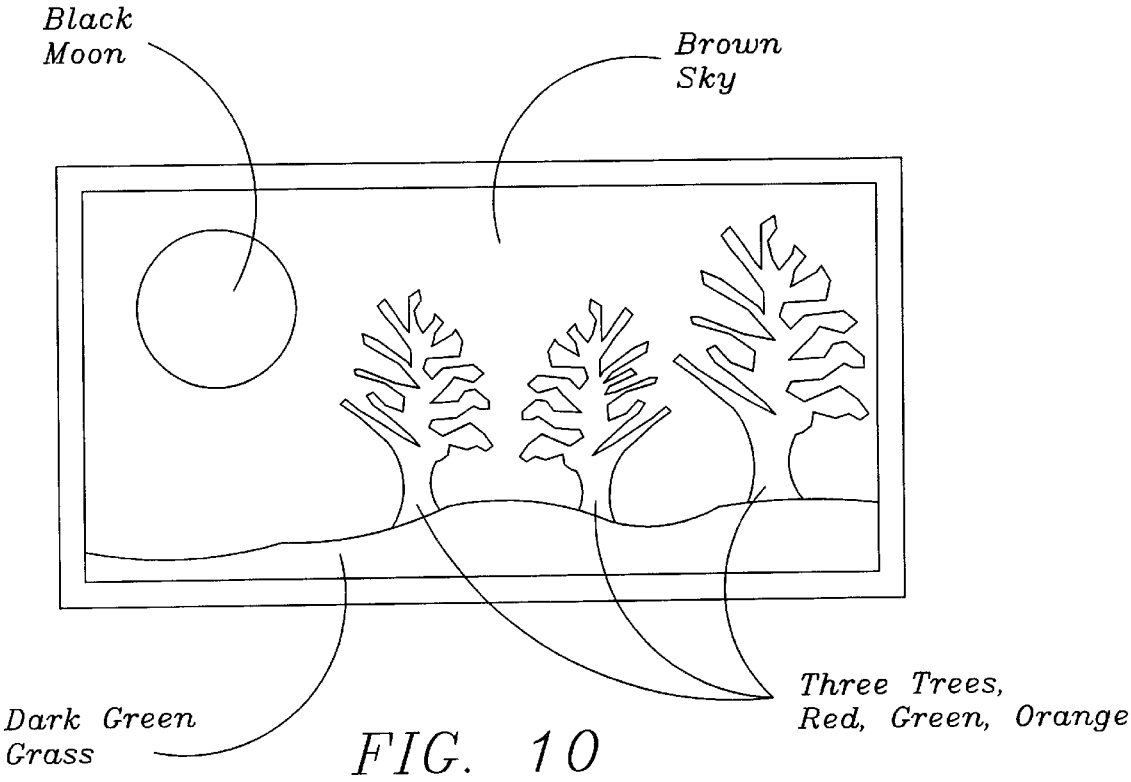
FIG. 10 is an orthographic view of the painting of FIG. 9, with the backlight on, illustrating how the sun may be made to appear as the moon, and multicolored trees and the ground may be made to appear.

Referring to FIGS. 9 and 10, an example canvas element 110 is illustrated. FIG. 9 illustrates the appearance wherein the lighting elements 308 are turned off. FIG. 10 is taken from the same perspective and is the view of the same side of the canvas element, but with the lighting elements turned on. The trees and ground are painted on the second surface 113, and appear only when the lighting elements are operational.

Figure 11:
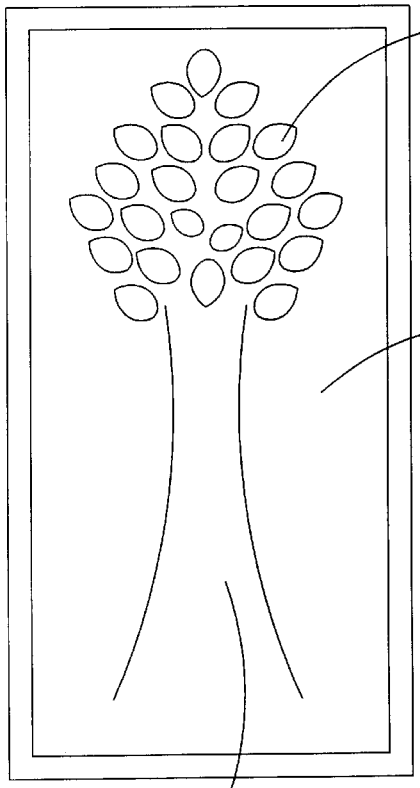
FIG. 11 is a view similar to that of FIG. 9, illustrating a further example of a painting with the backlight off.
Figure 12:
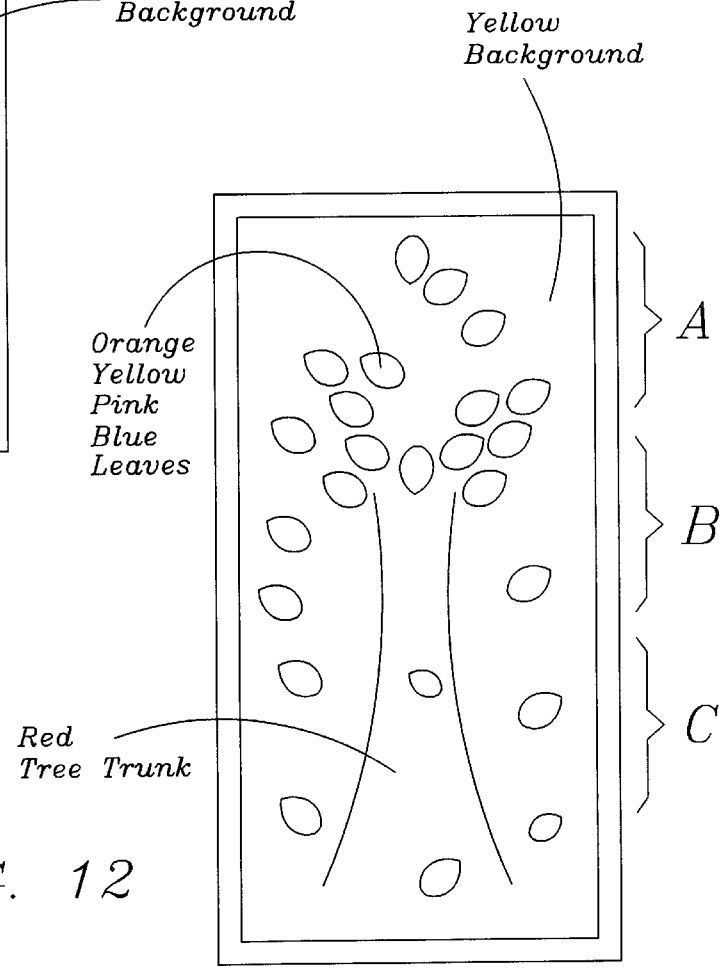
FIG. 12 is a view of the painting of FIG. 11, with the backlight on. The detached leaves may be made to appear to fall if backlights are turned on in sequence.

Referring to FIGS. 11 and 12, a second example canvas element is illustrated. FIG. 11 illustrates paint applied to the first surface 111, which is visible when the lighting elements are turned off. FIG. 12 illustrates the appearance when the lighting elements are turned on. Paint applied to the second surface 113 is visible only when the lighting elements are turned on.

Referring back to FIG. 1, it can be seen that multiple lighting elements 308 are available. Where the automatic switching assembly 500 is attached individually to each element 308, the elements may be turned on in sequence. For example, in FIG. 12, where the lighting elements in area A are turned on and then off, followed by the lighting elements in area B, followed by the lighting elements in area C, the illusion of motion results. More specifically, when the leaves present in areas A, B, and C are illuminated and darkened in sequence, it appears that the leaves are moving from area A to area B to area C, and are therefore falling.

Referring to FIGS. 1 and 2, a preferred lighting assembly 300 is seen. Wire-hiding rails 304 carry wires between the bulb sockets 306, a fluorescent tube operating ballast 302, and externally extending on/off switch 700. Where an automatic switching assembly 500 and/or automatic dimmer assembly 600 is used, the rails additionally contain the wiring to these devices.

In a preferred embodiment, where the rails are vertically directed, and a plurality of fluorescent bulbs are oriented horizontally. Optionally, these orientations may be reversed. Pairs of bulb sockets 306 are typically supported by the rails; each pair associated with a single fluorescent tube 308.

While in a preferred version of the invention, the lighting elements 308 are evenly spaced, it is also the case that some display graphics are better displayed with the lighting elements distributed in a non-uniform manner. For example, the artist may desire certain portions of the display graphics to be more or less illuminated, and the lighting elements moved correspondingly.

The automatic switching assembly 500 may individually control each lighting element 500. This allows sequential control of the lighting elements. For example, as seen in FIG. 12, where the lighting elements in region A are turned on and then off, followed by regions B and C, the second surface paint 114 painted on the second surface 113 is illuminated.

Referring to FIGS. 3, 4 and 5, an alternate lighting assembly 400 is seen. The lighting assembly provides illumination within the lighting cavity 236, allowing light to pass through the outer canvas element 110.

A similar secondary lighting assembly 402 provides illumination in an application wherein the display graphics 100 additionally comprises a second canvas element 120. In this application, light passes through both the inner and outer canvas elements before reaching the viewer.

The alternate and secondary lighting assemblies typically include a socket 422 and a lighting element 424. The lighting element preferably includes a fluorescent tube to minimize heat production within the lighting cavity. Wiring 426 connects the socket with the switch 700. Where needed, a transformer or ballast 428 may be provided to operate fluorescent tubes having such a requirement.

As a result of the translucent nature of the canvas elements comprising the display graphics, light will pass from the lighting cavity 236 through the display graphics, allowing it to be viewed. Thus, the viewer will see the color and intensity of the light leaving the forward surface that is dependent on the nature of the work of art, and the display graphics should be chosen accordingly.

Significantly, the viewer's perception of the display graphics is markedly different depending on whether the lighting assemblies are on or not, and also to voltage applied to them if they are on. In most applications, the difference between power on and off is that of two distinct, yet related, paintings.

The artwork displayed with the invention is typically "substantially planar" in nature. However, it may include elements of a three-dimensional nature, including relief drawings, collages and other works having characteristics not strictly planar in nature.

Referring to FIG. 3, the switching assembly 700 allows the user to manually control the operation of the lighting assembly by manual manipulation of an externally extending switch toggle 700. As seen in FIG. 3, the switch is typically visible from the side of the unit, but is behind the picture frame 280 and is therefore not visible from the front of the artistic display 10. Alternatively, the switch could be mounted into the bottom element 226 or other location, as desired.

In an alternative to a manual switch, a light-sensitive automatic switch could be substituted. Such a switch would automatically turn the lighting assembly on when the ambient lighting was low, and off when the ambient lighting was elevated, or the reverse.

Referring to FIG. 3, an automatic switching assembly 500 is may optionally be connected to the on/off toggle switch 700. When the toggle switch is turned on, the automatic switching assembly turns the power to the lighting assembly 300 on and off. As a result, the artistic display achieves added interest in viewers, since the appearance of the artistic display changes periodically. Note that with two automatic switching assemblies, the front and rear lighting assemblies 400, 402 may be operated independently of each other.

The automatic switching assembly includes a timer which cycles the power on and off according to a prescribed or random pattern. The prescribed pattern may be related to the hour of day; i.e. the artistic display can turn on and off with day and night. Alternatively, the automatic timer may follow a pattern that is independent of the hour of day and outside lighting level.

Referring to FIG. 3, an automatic dimming assembly 600 may optionally be connected between the automatic switching assembly and the lighting assembly 300. When the toggle switch is turned on and the automatic switching assembly has also turned on, the voltage level of that power may be varied by the automatic dimming assembly. Alternatively, the on-off functionality may be built into the dimmer assembly. As a result, the artistic display achieves added interest in viewers, since the appearance of the artistic display changes periodically, due to the continual variance of the lighting level. Note that with two automatic dimming assemblies, the voltage applied to the front and rear lighting assemblies may be operated independently of each other.

The automatic dimming assembly includes a timer which cycles the voltage up and down according to a prescribed or random pattern. The prescribed pattern may be related to the hour of day; i.e. the artistic display can turn brighter and dimmer in concert with day and night, or in contrast to day and night. Alternatively, the automatic dimmer may follow a pattern that is independent of the hour of day and outside lighting level.

Where desired, the switch 700 may be replaced by a manually operated combination on-off and dimmer switch.

Figure 6:
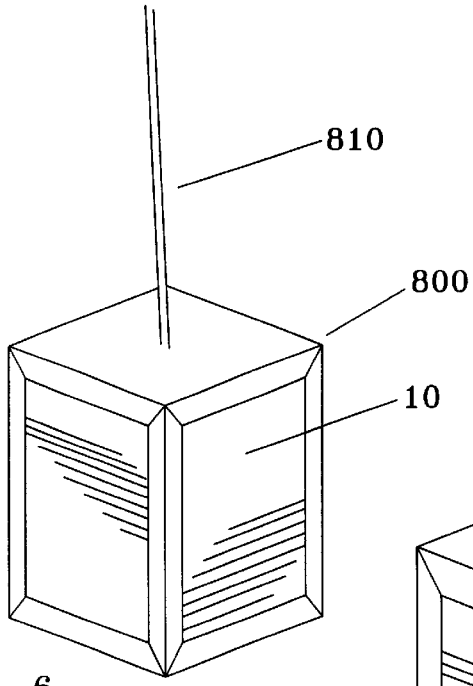
FIG. 6 is a perspective view of a lamp made of four of the backlighting boxes of FIG. 1, having a supporting cable to allow suspension from the ceiling.

In a typical application, single artistic displays 10 may be hung on the wall to display individual works of art. However, as seen in FIG. 6, a plurality of artistic displays may be joined to form a lamp 800 or similar lighting fixture which may be supported on a table, pedestal or by a cable 810 from the ceiling.

Figure 7:
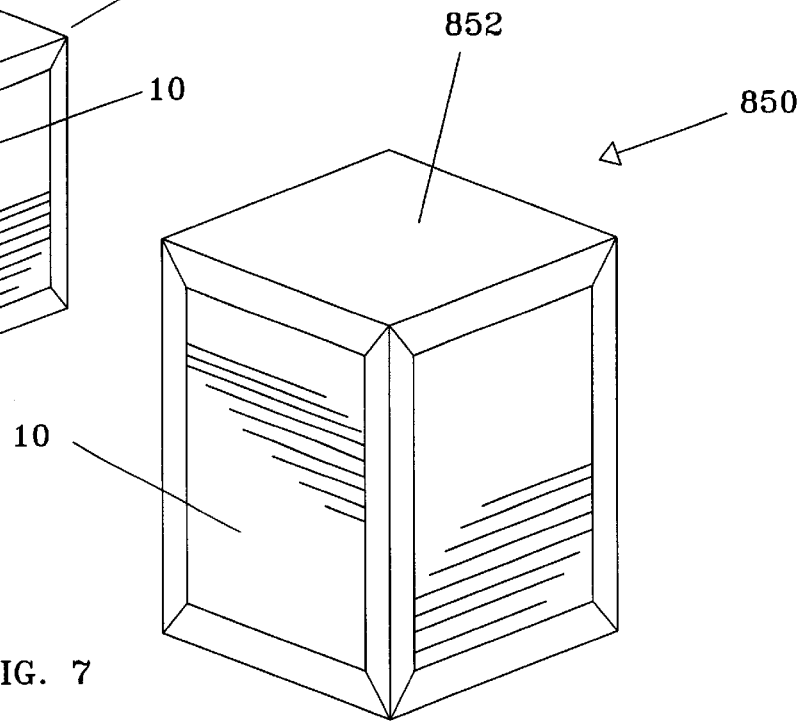
FIG. 7 is a perspective view of a small end table or similar piece of furniture made of four of the backlighting boxes of FIG. 1, arranged in a manner suitable to support a table surface.

Similarly, as seen in FIG. 7, a plurality, including at least three, but typically four, artistic displays 10 may be joined along adjacent side elements 222 to form a base upon which a table surface 852 may be supported. In this manner, small end tables 850, coffee tables and other pieces of furniture may be formed. Such furniture would have the characteristics of the backlighting boxes, i.e. the furniture would be attractive, luminous, and would advantageously display art.

Figure 8:
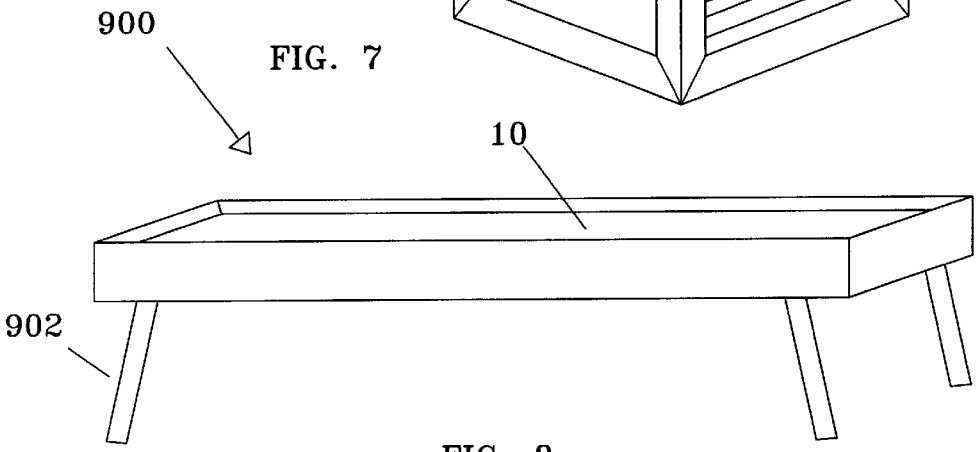
FIG. 8 is a perspective view of a coffee table or similar piece of furniture having a table surface comprising one of the backlighting boxes of FIG. 1.

As seen in FIG. 8, in a variation of the table of FIG. 7, the artistic display 10 is used as the table surface of a coffee table 900. Narrow legs 902 or other supports carry the table surface at a desired elevation.

The previously described versions of the present invention have many advantages, including a primary advantage of providing a novel artistic display having one or more canvas elements having paint applied to portions of surfaces on both sides, and supported by a backlighting box frame having one or more lighting assemblies which illuminate the canvas elements for viewing. In particular, it is a primary advantage that the appearance of the artistic display with the lighting assemblies on is markedly different than with them off. Moreover, the interaction between the two appearances is also advantageous.

Another advantage of the present invention is to provide a novel artistic display, having one or more canvas elements lit from behind by one or more lighting assemblies, that may also be used to provide low-level, subtle lighting for an adjacent area, and which may be used as a lamp or lighting fixture.

Another advantage of the present invention is to provide a novel artistic display, having display graphics comprising a canvas element carried by a picture frame having fastening means which allow reversal of the picture frame and canvas element, whereby the painting on either side of the canvas element may be directed outwardly.

A still further advantage of the present invention is to provide a novel artistic display, having one or more canvas elements lit from behind by one or more lighting assemblies, wherein the lighting assemblies interacts with the paint on both sides of each canvas element, enhancing and altering the colors and intensities of the work, in some cases changing the appearance of the art by making visible textures and other features resulting from different levels of light transmission through different areas of the work.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while a number of reasons, including heat production and light diffusion favor fluorescent tube lighting elements, other types of light sources, such as incandescent, laser, diode and others could also be employed. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An artistic display, comprising:

(A) a backlighting box frame;

(B) a back wall, carried by a rear peripheral surface of the backlighting box frame;

(C) a picture frame, carried by a front perimeter surface of the backlighting box frame;

(D) a canvas element, carried by the picture frame, the canvas element defining first and a second surfaces, the first and second surfaces each having a coating of paint;

(E) fastening means, carried by the front perimeter surface of the backlighting box frame and by a front and a back surface of the picture frame, for allowing either side of the picture frame to be attached to the front perimeter surface of the backlighting box frame, thereby allowing the canvas element to be easily reversed; and (F) a lighting assembly, carried by the backlighting box frame, immediately behind the canvas element.

2. An artistic display, comprising:

(A) a backlighting box frame;

(B) a back wall, carried by a rear peripheral surface of the backlighting box frame, and a picture frame, carried by a front perimeter surface of the backlighting box frame;

(C) a canvas element, carried adjacent to the backlighting box frame, the canvas element defining first and a second surfaces, the first and second surfaces each having a coating of paint;

(D) a lighting assembly, carried by the backlighting box frame, immediately behind the canvas element;

(E) automatic switching assembly means, in electrical communication with the lighting assembly, for cycling power to the lighting assembly on and off, the automatic switching assembly means including timer means for cycling power in concert with a predetermined pattern; and (F) fastening means, carried by the front perimeter surface of the backlighting box frame and by a front and a back surface of the picture frame, for allowing either side of the picture frame to be attached to the front perimeter surface of the backlighting box frame, thereby allowing the canvas element to be easily reversed.

3. An artistic display, comprising:

(A) a backlighting box frame;

(B) a back wall, carried by a rear peripheral surface of the backlighting box frame, and a picture frame, carried by a front perimeter surface of the backlighting box frame;

(C) a canvas element, carried adjacent to the backlighting box frame, the canvas element defining first and a second surfaces, the first and second surfaces each having a coating of paint;

(D) a lighting assembly, carried by the backlighting box frame, immediately behind the canvas element;

(E) automatic switching assembly means, in electrical communication with the lighting assembly, for cycling power to the lighting assembly on and off, the automatic switching assembly means including timer means for cycling power in concert with a predetermined pattern; and (F) automatic dimmer assembly means, in electrical communication with the lighting assembly, for cycling an applied voltage to the lighting assembly in a manner that raises and lowers the illumination level of the lighting assembly, the automatic dimmer assembly means including timer means for cycling voltage in concert with a predetermined pattern.

4. The artistic display of claim 3, additionally comprising:

(A) a reflective surface, carried by an inside surface of the back wall.

* * * * *